US007089662B2

(12) United States Patent
Izquierdo et al.

(10) Patent No.: US 7,089,662 B2
(45) Date of Patent: Aug. 15, 2006

(54) METHOD FOR SURFACE TREATMENT OF THE INTERIORS OF ENGINE CYLINDER BORES, AND CYLINDERS MADE BY SAID METHOD

(75) Inventors: Patrick Izquierdo, Ulm (DE); Karl-Heinz Kaiserauer, Ehningen-Erbstetten (DE); Michael Lahres, Ulm (DE); Oliver Storz, Blaustein (DE)

(73) Assignee: DaimlerChrysler AG, Stuttgart (DE)

( * ) Notice: Subject to any disclaimer, the term of this patent is extended or adjusted under 35 U.S.C. 154(b) by 0 days.

(21) Appl. No.: 10/963,657

(22) Filed: Oct. 14, 2004

(65) Prior Publication Data

US 2005/0044707 A1 Mar. 3, 2005

Related U.S. Application Data

(63) Continuation of application No. 09/389,386, filed on Sep. 3, 1999, now abandoned.

(30) Foreign Application Priority Data

Sep. 3, 1998 (DE) ..... 198 40 117

(51) Int. Cl.
*B23P 11/00* (2006.01)

(52) U.S. Cl. ..... 29/888.061; 29/557

(58) Field of Classification Search ..... 29/888.06, 29/888.061, 888.01, 557, 558, 527.2; 451/51; 427/446–456; 408/709; 409/218
See application file for complete search history.

(56) References Cited

U.S. PATENT DOCUMENTS 4,625,465 A 12/1986 Kirt
4,980,996 A 1/1991 Klintz et al.
5,042,202 A 8/1991 Klein et al.
5,085,014 A 2/1992 Sandhof
5,331,775 A 7/1994 Carmichael et al.
5,363,821 A 11/1994 Rao et al.
5,601,476 A 2/1997 Maier et al.
5,622,753 A 4/1997 Shepley et al.
5,691,004 A 11/1997 Palazzolo et al.

FOREIGN PATENT DOCUMENTS

DE 195 08 687 3/1995
EP 0 716 158 6/1996

OTHER PUBLICATIONS

Spanende Fertigung—Increasing Flexibility in Finishing.
Hohere Spharen—Higher Spheres.
Hartdrehen uberholt Feinschleifen—Turning.
Steidle GmbH (company)—Advertisement, "Minimal Mengen-Kuhl Schmierung", (machine with cooling mechanism).
Huls (company)—Product Information on "Softenol" (oil based or raw material), 1996.
Schulz, "Tribology—Solving Friction and Wear Problems", Technische Akademie Esslingen, 10th International Colloquium, Jan. 9-11, 1996, pp. 727-738.
Prof. Dr.-Ing. Michael Kaufeld, "Trockenzerspanung von Aluminiumlegierungen in HSC-Technologie", Kasseler Kolloquium, Sep. 17-19, 1997, Kassel, Germany, with English translation.

*Primary Examiner*—T. Nguyen
(74) *Attorney, Agent, or Firm*—Crowell & Moring LLP

(57) ABSTRACT

A method for surface treatment of the interiors of hollow bodies, especially cylinder bores, in preparation for the application of a thermally sprayed layer. The method comprises dry cutting without a lubricant or with a shortage of lubricant using a tool having a defined and/or undefined surface profile. In this method with a portion of the material forming the interior is removed and produces a surface that has a defined structure and/or quality. This eliminates the need for costly degreasing of the surface following machining.

8 Claims, 1 Drawing Sheet

METHOD FOR SURFACE TREATMENT OF THE INTERIORS OF ENGINE CYLINDER BORES, AND CYLINDERS MADE BY SAID METHOD

This application is a continuation of application Ser. No. 09/389,386, filed Sep. 3, 1999 now abandoned.

BACKGROUND AND SUMMARY OF THE INVENTION

A method according to the species is known from EP 0 716 158 A1. In that patent, a method is described for producing engine blocks with coated cylinder bores in which the engine block is initially cast from a metal and then dirt residue is removed from the walls of the cast cylinder bores so that initially an annular cleaned fresh metal surface is prepared. Then a plasma-sprayed layer is deposited on this pretreated surface and this layer is then finished.

The cylinder bores are usually prepared by machining them with corundum blasting followed by grease removal. The goal is to obtain a grease-free surface with a roughness (R) value of approximately 25 to 65 μm. Roughness (R) is determined by calculating the average peak to valley height of the surface of the machined cylinder bore. The problem is that the cylinder bores must be in precise position following preparation since after casting, the position of the cast cylinder bore can differ significantly from the prescribed value. In the manufacture of engine blocks from hypoeutectic aluminum by die casting, there is the additional problem that as a result of the casting process, inhomogeneities can develop especially in the lower part of the cylinder bores. Bubbles or pores can form in the material, caused by a shrinking process during casting (so-called shrink holes). During surface treatment and roughening, these pores or bubbles are exposed and can be further enlarged. Blasting residue and solvents or lubricant residues can remain in the open bubbles which results in poor adhesion of the applied tribological layer. Since the coating takes place at high temperatures, the solvent that remains in the open bubbles expands so that depressions and chips further worsens the adhesion of the tribological layer to the wall.

A goal of the present invention therefore is to provide a method of the type described above which provides grease-free surfaces of a certain surface quality in a method that is as simple as possible, onto which surface the thermally sprayed layers can be applied in simple fashion and with good adhesion.

The solution includes dry-cutting the interior in a method step without lubricant using a tool having a defined and/or undefined surface profile.

The term "dry cutting" means that no lubrication is used or that at most minimum lubrication with a volume flow of less than 150 ml/h is used in which the chips or the surface are considered to be dry.

Therefore, provision is made according to the invention for machining the bores when they are dry, for example by drilling, brushing, knurling, circular milling, or combinations of one or several of these methods.

The tool can have a defined surface profile so that after machining, a surface with a defined structure (S) results. Subsequent degreasing or cleaning and roughening are eliminated. Following surface treatment, a layer can be applied immediately by thermal spraying.

Other objects, advantages and novel features of the present invention will become apparent from the following detailed description of the invention when considered in conjunction with the accompanying drawings.

DETAILED DESCRIPTION OF THE DRAWINGS

Figure 1:
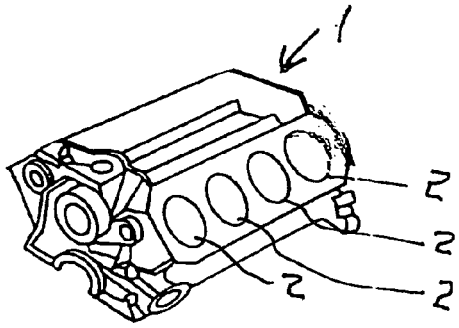
FIG. 1 is a perspective view of a combustion engine cylinder block, having cylinder bores of the kind to be processed according to preferred embodiments of the present invention.

FIG. 1 depicts a cast internal combustion engine block 1 of the kind to be processed according to the present invention. Engine block 1 includes a plurality of cylinder bores 2. The cylinder bores 2 are cleaned, then dry cut using a cutting tool T schematically depicted in FIGS. 2 and 3. The dry cutting is carried out without first applying lubricant (or by applying minimal lubricant with a flow of less than 150 ml/h (milileters per hour) to a respective cylinder bore so that the surfaces are considered as "dry").

Figure 2:
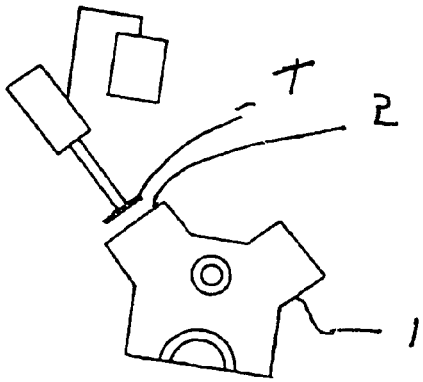
FIG. 2 is a schematic view depicting a dry cutting of a cylinder bore according to preferred embodiments of the present invention.
Figure 3:
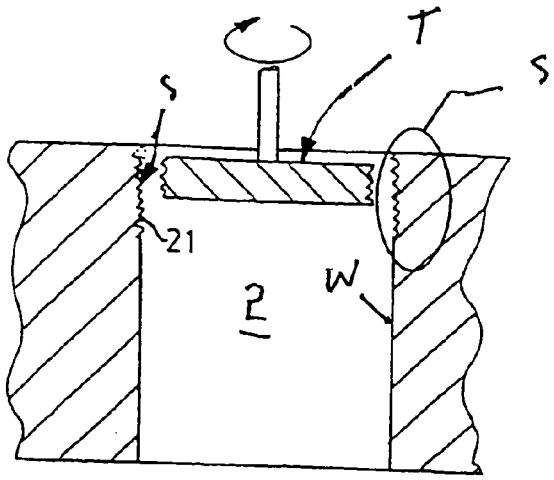
FIG. 3 is an enlarged schematic sectional view depicting the dry cutting of a cylinder bore according to preferred embodiments of the present invention, for a predetermined surface S.

The cutting tool T, schematically depicted in FIGS. 2 and 3, is comprised of cubic boron nitride, polycrystalline diamond, a coated or uncoated hard metal, or a ceramic. Steel wire with or without a coating or ceramic is used as the brush material. As the knurl, any coated or uncoated surface profiles of hard metal or MSS or ceramic can be used. A tool T with a defined surface profile for example can be a cutting tool or a tool fitted with one or more rollers, with the roller comprising a hard metal, ceramic or MSS, coated or uncoated. When a cutting tool T with a defined surface profile is used, preferably one or more cutting devices comprise cubic boron nitride, polycrystalline diamond, a coated or uncoated hard metal, or a cutting ceramic.

The hard metal can be manufactured in particular on the basis of titanium carbide or tungsten carbide. The cutting ceramic can consist especially of silicon nitride or aluminum oxide.

The cutting tool T can be an indexable insert, for example with a certain surface structure. The cutting tool T for example can also be a tool fitted with a plurality of indexable inserts such as a cutting spindle. The cutting tool T can be steel wire with or without a coating or a ceramic or a hard material with an undefined surface profile.

Therefore it is possible with the method according to the invention to prepare cylinder bores in particular with dimensional and position tolerance with a certain surface quality (21) for coating with a thermally sprayed layer.

EXAMPLE

The following are parameters of a typical example used for dry cutting the interior of the hollow body (W) and the resulting roughness (R) of the surface of the machined hollow body:

Cutting tool: TCMW 110208F CD10
RPM: 800 min
Feed: 30 mm/min
Surface Layer: APS-AlSi25Ni4Fe1.2Mg1.2
Roughness (R): 1.3 μm The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. A method of making a cylinder bore in an engine block, comprising:

obtaining a grease-free surface with a roughness value of approximately 25 to 65 μm by dry cutting an interior of the cylinder bore with no lubricant using a tool having a surface profile, wherein a portion of a material forming the interior is removed so as to produce a surface having a defined quality or structure and said roughness value; and thermally-spraying a layer onto the surface, without prior degreasing or cleaning.

2. The method of claim 1, wherein the dry cutting is performed by drilling, brushing, knurling, circular milling or combinations thereof.

3. The method of claim 1, wherein the tool comprises cubic boron nitride, polycrystalline diamond, a coated or uncoated hard metal or a ceramic.

4. The method of claim 1, wherein the tool is an indexing insert.

5. The method of claim 1, wherein the tool is fitted with a plurality of indexing inserts.

6. A process for surface coating an interior side of a cylinder bore, comprising:

obtaining a grease-free surface with a roughness value of approximately 25 to 65 μm by removing a portion of material forming the interior side of the cylinder bore to be coated by dry cutting the interior side with no lubricant using a cutting tool with a defined surface profile, thereby creating a surface having at least one of a defined structure or quality and said roughness value; and directly applying a thermally sprayed tribological layer to the surface, without prior degreasing or cleaning.

7. A process for surface coating an interior side of a cylinder bore, comprising:

obtaining a grease-free surface with a roughness value of approximately 25 to 65 μm by removing a portion of a material forming the interior side of the cylinder bore to be coated by dry cutting the interior side with no lubricant using a cutting tool with an undefined surface profile, thereby creating a surface having at least one of a defined structure or quality and said roughness value; and directly applying a thermally sprayed tribological layer to the surface, without prior degreasing or cleaning.

8. A process for surface coating an interior side of a cylinder bore, consisting of:

obtaining a grease-free surface with a roughness value of approximately 25 to 65 μm by removing a portion of material forming the interior side of the cylinder bore to be coated by dry cutting the interior side with no lubricant, thereby creating a surface having at least one of a defined structure or quality and said roughness value; and directly applying a thermally sprayed tribological layer to the surface, without prior degreasing or cleaning.

* * * * *